United States Patent [19]

Gallusser et al.

[11] Patent Number: 4,703,987

[45] **Date of Patent: * Nov. 3, 1987**

[54] APPARATUS AND METHOD FOR RETAINING AN INSERT IN AN ELECTRICAL CONNECTOR

[75] Inventors: David O. Gallusser, Oneonta; David W. MacAvoy, Bainbridge, both of N.Y.

[73] Assignee: Amphenol Corporation, Wallingford, Conn.

[ * ] Notice: The portion of the term of this patent subsequent to Jul. 28, 2004 has been disclaimed.

[21] Appl. No.: 781,294

[22] Filed: Sep. 27, 1985

[51] Int. Cl.[4] ..... H01R 11/00

[52] U.S. Cl. ..... 439/595; 29/882; 439/600

[58] Field of Search ..... 339/59-61; 29/876, 882, 881, 520, 521, 523

[56] References Cited

U.S. PATENT DOCUMENTS

| | | | |
|---|---|---|---|
| 1,914,109 | 6/1933 | Cardieux . | |
| 2,865,011 | 12/1958 | Dejadon | 339/150 |
| 2,974,400 | 3/1961 | Sowa | 29/135.55 |
| 3,909,936 | 10/1975 | Ray | 29/629 |
| 4,019,799 | 4/1977 | Bouvier | 339/59 R |
| 4,053,200 | 10/1977 | Pugner | 339/177 R |
| 4,059,330 | 11/1977 | Shirey | 339/177 R |
| 4,062,612 | 12/1977 | Evans | 339/94 A |
| 4,063,351 | 12/1977 | Borsuk et al. | 29/629 |
| 4,099,323 | 7/1978 | Bouvier | 29/629 |

OTHER PUBLICATIONS

Ser. No. 781,156, "Retaining an Insert in an Electrical Connector" (filed Sep. 27, 1985), Punako et al.

Ser. No. 867,165, "Electrical Connector with Deformable Retention Element and Procedure for Assembly of Such a Connector" (filed May 27, 1986).

*Primary Examiner*—Gil Weidenfeld

*Assistant Examiner*—Paula A. Austin

*Attorney, Agent, or Firm*—Bacon and Thomas

[57] ABSTRACT

A deformable plastic strip (44') is longitudinally slotted (60) along one edge to define a plurality of laterally separated longitudinal columns (62), cut, and then rolled into a tubular sleeve to form a retention member (44) which is configured to be coaxially driven into an annular passageway (72) formed between an insert (24) and a connector shell (10), engagement of the slotted end portion with an axial shell face (16) causing the columns to axially collapse in accordion like fashion and radially wedge themselves into the passageway whereby to interferencingly retain the insert in the shell.

14 Claims, 5 Drawing Figures

APPARATUS AND METHOD FOR RETAINING AN INSERT IN AN ELECTRICAL CONNECTOR

BACKGROUND OF THE INVENTION

This invention relates to a separable electrical connector having an improved arrangement for retaining an insert within a shell.

An electrical connector of the type herein includes a dielectric insert which is retained in a metallic shell and carries a plurality of conductive terminals in electrical isolation from the shell for mating with a respective plurality of terminals in a second connector. The dielectric insert typically is hard and can either be comprised of a thermoset or a thermoplastic material with good dielectric properties for circuit isolation.

Previous approaches for retaining an insert assembly within the shell have included upset staking of the shell, metal ring staking, and copper mesh/epoxy laminate staking. Each of these offer excellent retention but may introduce a conductive path between the insert assembly and shell. In "Electrical Connector" U.S. Pat. No. 4,019,799 and "Method of Making Electrical Connector" U.S. Pat. No. 4,099,233 issuing to Bouvier, respectively, Apr. 26, 1977 and July 11, 1978, and each incorporated herein by reference, it has been found that deforming the conductive mesh laminate by a crushing action caused the mesh to invade into the bond interface between a hard wafer and a resilient grommet whereupon a conductive path could be established between the outer row of terminals and the shell thereby causing a ground short to exist.

Other approaches have included epoxy staking, interference fits with epoxy, and self-snapping mechanisms, all of which protect against a conductive path to the shell but do not offer a good insert retention system. Epoxy does not have an internal reinforcement to prevent break up under extreme conditions of temperature and pressure. Further, the interference fits with epoxy rely on the epoxy to take up sloppy fits due to tolerancing. Slippage and loose friction fits could lead to insert pull-out. Self snapping mechanisms introduce loose inserts due to tolerancing difficulties.

Another approach has utilized a non-metallic laminate mesh. This offers good retention and assures a non-conductive path between the insert and shell but is hard to handle and process.

Provision of a non-conductive insert retention system that would be inexpensive, adaptable to a wide range of connector shells having different diameters and internal cross-sections, easy to manufacture, easy to assemble, and assure the user of insert retention integrity would be desirable.

SUMMARY OF THE INVENTION

This invention contemplates an electrical connector comprising a metal shell that includes an annular groove on its inner wall, a dielectric insert having an outer periphery disposed in the shell so that an annular passageway is provided between the shell and the insert, and a retention arrangement for retaining the insert in the shell.

In accordance with this invention, a retention member comprised of an elongated strip of a deformable thermoplastic material is scalloped along its front face by longitudinal slots to provide a plurality of axially weakened columns which will collapsingly fold onto one another and stack together in accordion like fashion and radially interferencingly wedge themselves in the annular pasasgeway when the strip front face engages an axial wall at the end of the passageway formed between the insert and the shell. The inner wall includes an annular groove which encircles the outer periphery and cooperation between axial faces of the groove and radial folds requires shear forces to shear the accordion-like folds for the insert to be removed.

DETAILED DISCUSSION OF THE INVENTION

Figures 1, 2, 3:
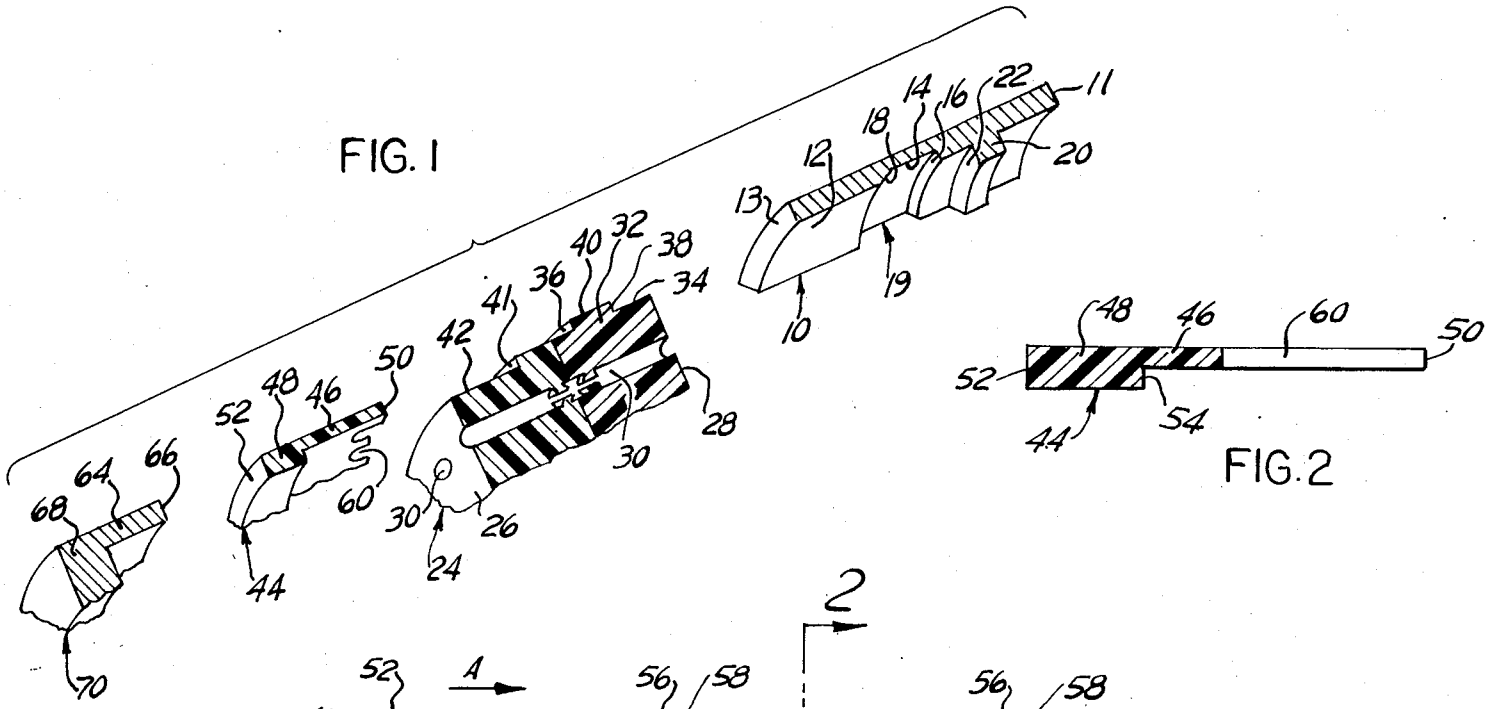
FIG. 1 is a partial cross-sectional exploded view of a connector assembly including an insert adapted to be inserted into a shell and a tool positioned to force an tubular sleeve between the assembled shell and insert.
FIG. 2 is an enlarged section view of an insert retention member.
FIG. 3 is a plan view of an elongated strip and an insert retention member of FIG. 2 formed therefrom.

Referring now to the drawings, FIG. 1 illustrates a metallic connector shell 10 a dielectric insert 24, an insert retention member 44, and an insert tool 70 each coaxially aligned for assembly along a central axis. The insert and shell have complementary cross-sections such that when the insert is fitted into the shell, an axially extending annular passageway 72 is formed for receiving the insert member (See FIG. 4). The shell and insert are generally cylindrical and of one piece but are shown in section for clarity of description of the insert retention.

The shell 10 is open at each of its opposite axial ends and includes a forward mating end 11, a rearward entry end 13, an inner wall 12, an annular groove 19 disposed within the inner wall, and a radial flange 20 extending radially inward from the inner wall. The annular groove comprises a first axial face 16 disposed in a plane generally perpendicular to the central axis and facing rearwardly, a flared frusto-conical axial face 18 facing forwardly, and an annular wall 14 extending between the faces and generally coaxially extending relative to the inner wall. The flange 20 includes an endwall 22 that faces rearwardly and provides a stop which limits inward axial insertion of the insert into the shell.

The insert 24 is typically comprised of polypheniline sulfide such as commercially available under the trade name Torlon, and includes a front face 28, a rear face 26, and a plurality of passages 30 extending between the faces for receiving an electrical contact (not shown) therein for mating. The cross-section of the insert is stepped and includes a first surface 34 defining an outer periphery, a second surface 40 extending radially outward from the outer periphery to define a collar 32, and a third surface 42 extending radially inward from the outer periphery to define a shoulder 41 leading to an inward recess, each of the surfaces being generally coaxially defined relative to the central axis of the insert. The collar 32 includes a rear face 36 facing rearwardly, and a front face 38 facing forwardly and adapted to abut endwall 22 of the radial flange. The second surface 40 of the insert which defines the outer periphery of the collar is adapted to clearance fit against the inner wall 12 of the shell 10 so as to position the rearwardly facing end wall 36 of the collar medially of the annular groove 19 which will encircle it when the insert is within the shell. As shown, a pair of cylindrical inserts are bonded together into a single member with the bond interface indicated at 31.

The retention member 44 is formed into a tubular sleeve from a flat sheet of a thermoplastic material, the sleeve having a forward portion 46 substantially thinner than a rearward portion 48 with a front face 50 being scalloped by slots 60 extending therefrom towards its to a rear face 52.

Retention member 44 is comprised of a material that would be resiliently deformable and not be crackable, have good properties of elongation, shear strength and high temperature capability. Such a material is a thermoplastic such as would include a polyether sulfone and a polyetherimide.

The insertion tool 70 includes a body 68 and a cylindrical mandrel 64 extending to a front action surface 66 adapted to engage the rear face 52 of the retention member 44 whereby to drive the retention member into the annular passageway 72 formed between the inner wall of shell and the outer periphery of the insert when the insert is inserted within the shell.

FIG. 2 shows a cross-section of the retention member 44 such as would be seen looking along lines II—II of FIG. 3. The retention member has generally parallel top and bottom faces for each of its forward and rearward portions 46, 48, the rearward portion being the thicker of the two and defining a forwardly facing endwall 54 which is adapted to engage the shoulder 41 on the insert whereby to trap the rearward portion of the two piece insert.

FIG. 3 shows the retention member 44 as being formed from an elongated-continuous strip 44' of non-conductive thermoplastic material. As the strip is advanced in the direction "A" a plurality of slots 60 which extend perpendicularly from its front face 50 inwardly towards its rear face 52 are formed to define a plurality of laterally separated weakened axial columns 62 which are adapted to collapse upon a sufficient external force being placed on them. The strip is first slotted and then severed into strip portions each which define the retention member 44. The severing could be perpendicular to the front and rear faces of the strip 44 whereby form a rectangular shape having lateral endfaces 56, 58, as shown, or at an acute angle to the front and the rear endfaces whereby to form a parallelogram shape (not shown). Following each severing, depending on the shape or configuration desired, the respective lateral endfaces are wrapped around and brought into abutment with one another to form a tubular sleeve having a cross-section sized for insertion into the annular passageway. The shape of the slots 60, while being shown as having a U-shaped root, could be otherwise.

Figure 4:
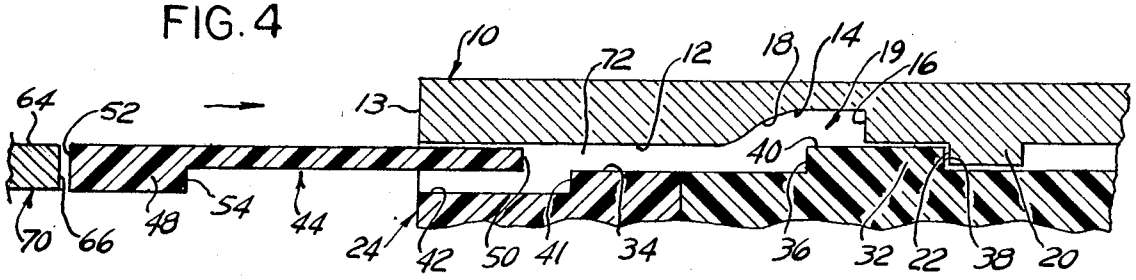
FIG. 4 is a partial cross-section of the insert disposed within the shell and the retention member being inserted between an axial annular passageway therebetween.

FIG. 4 shows the insert 24 clearance fit within the shell 10 with the front face 38 of its collar 32 abutting against the endwall 22 of the radial flange 20 whereby to position the insert therewithin so that the annular groove encircles the collar. The axially extending annular passageway 72 is formed between the outer periphery of the insert and the inner wall 12 of the shell. The retention member 44 is inserted inwardly into the passageway 72 from the rearward entry end 13 of the shell. The difference between the distance between endwall 54 of the rearward portion 48 and the front face 50 of the forward portion 46 and the distance between the shoulder 41 of the insert and the axial face 16 of the shell defines a collapsible volume which is adapted to collapse in accordion like fashion whereby to radially wedge itself within the annular groove 19.

While rear face 36 is shown as being substantially at a right angle, a chamfer (i.e., tapered) surface would also work).

Figure 5:
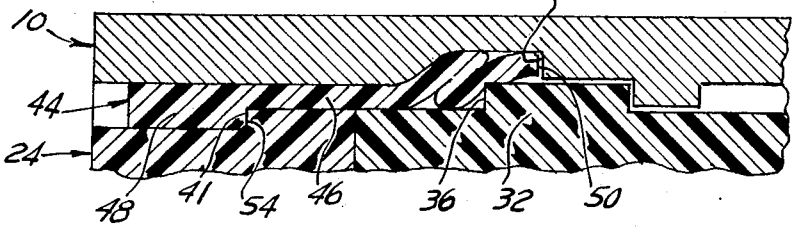
FIG. 5 shows an assembled relationship.

FIG. 5 shows the result of continued insertion of the retention member into the passageway. The front face 50 is driven into engagement with the rearwardly facing axial face 16 of the annular groove 19. Further external force causes the columns 62 to collapse in an accordion-like fashion whereby to fold over themselves and have portions thereof driven radially upward as the column folds stack. Portions of the folded accordion are interferencingly wedged within the annular groove and around the insert whereby to engage the insert and shell. When the endwall 54 abuts the shoulder 41 of the insert 24, the assembler knows that the insert staking operation is complete.

Because of the accordion-like portion being formed by a plurality of radial column folds and disposed between axial faces and in the annular groove, insert withdrawal can only come about as a result of shear forces sufficient to shear the folds.

We claim:

1. In an electrical connector assembly of the type including a shell having a cylindrical inner wall, an insert, having a cylindrical outer periphery, disposed within an annular passageway defined by and located between the inner wall and the outer periphery of the insert, and retention means for retaining the insert within said shell, said retention means being characterized by an annular rentention member of deformable material being foldingly wedged radially between the shell and the insert, said retention member including a forward end portion and a rearward end portion with said forward end portion being longitudinally slotted and collapsingly folded axially and radially to be wedged interferencingly in the passageway, said retention member having the forward end portion substantially thinner than the rearward end portion and the rearward end portion defining a forwardly facing endwall, and said insert defining a shoulder leading to the passageway between the inner wall and the outer periphery whereby when the forwardly facing endwall abuts said shoulder during assembly the assembler knows that the assembly operation is complete.

2. The connector assembly as recited in claim 1 wherein said retention member comprises an axially elongated strip of material being formed into a cylinder, said strip having a front and a rear face and a plurality of longitudinal slots extending rearwardly from the front face to define a plurality of laterally spaced and axially weakened columns which foldingly collapse in the passageway.

3. The connector assembly as recited in claim 2 wherein the inner wall of said shell includes an annular groove and a flange each encircling said outer periphery, and said insert has a front face abutting said flange, said annular groove including an axial face whereby to define a stop for the slotted front face of said retention member, said groove receiving some of the forward end portion of said columns collapsingly folded therein.

4. The connector assembly as recited in claim 2 wherein the inner wall, the outer periphery, and the annular passageway are coaxially extending, and the annular groove includes said axial face, a frusto-conical forwardly facing second axial face, and a second inner wall extending between the axial faces.

5. A method of retaining a generally cylindrical insert within a shell having a generally cylindrical inner wall, the steps of the method comprising:

forming an annular groove on the inner wall to provide a rearwardly facing axial face, reducing the cross-section of the insert to reduce the outer periphery and provide a collar that extends radially outward therefrom, the inner wall having a diameter dimensioned so as to clearance fit about the collar and define an annular passageway about the inner wall, and the insert being formed such that it defines a shoulder leading to the annular passageway defined by the insert, removing a plurality of strip portions from an elongated strip of plastically deformable non-conductive material to define a plurality of laterally separated longitudinally weakened columns, inserting the insert into the shell so that the collar is adjacent to the axial face, forming the strip into a retention member having a cross-section corresponding to that of the annular passageway, and the forming operation being such that the forward end portion is substantially thinner than the rearward end portion thereof, the rearward end portion defining a forwardly facing endwall, and inserting the retention member into the passageway a distance sufficient to have its front face engage the axial face with continued inserting being with an external force sufficient to cause the longitudinal columns to axially and radially collapse within the passageway and fold together in accordion like fashion to become interferencingly wedged between the insert and the shell with the forwardly facing endwall abutting the shoulder of the insert.

6. The method as recited in claim 5 wherein the removing step includes longitudinally slotting the strip from the front face rearwardly to provide a plurality of laterally spaced, longitudinal slots and columns.

7. The method as recited in claim 5 wherein said elongated strip is continuous and of generally uniform cross-section and includes a rear face generally parallel to its front face, and the forming step further comprises cutting the elongated strip into a strip portion having lateral ends which are abutted to form the retention member.

8. The method as recited in claim 7 wherein the cutting is in a direction generally perpendicular to the front and rear faces whereby to form a generally rectangular shaped strip portion having laterally spaced ends, and the forming step includes abutting the lateral ends to provide a closed sleeve.

9. The method as recited in claim 7 wherein the cutting is in a direction generally angled to the front and rear faces whereby to form a parallellogram shaped strip portion having laterally spaced ends, and the forming step includes abutting the lateral ends to provide a closed sleeve.

10. A method of retaining a generally cylindrical insert within a generally cylindrical shell, an outer diameter of the insert being slightly less than an inner diameter of the shell, the steps of the method characterized by:

removing a cylindrical portion of one said shell and insert to provide an axial face facing axially rearward, said removed cylindrical portion leaving an axially extending annular passageway between said shell and insert, and further, said insert formed such that it defines a shoulder spaced from the inner wall of the shell leading to the annular passageway, forming a tubular sleeve from a piece of deformable non-conductive material, said tubular sleeve having a front face, a rear face and a forward end portion, the forward end portion being characterized by a plurality of generally equiangularly spaced, axially weakened, longitudinal column, and the sleeve being formed such that the forward end is substantially thinner than the rearward end, the rearward end defining a forwardly facing endwall, and inserting the forward end portion of the deformable sleeve into the annular passageway until its front face engages the axial face, the insertion force then being increased by an amount sufficient to cause the forward end portion of the columns to foldingly collapse therewithin in accordion-like fashion to form a radially folded wedged accordion portion therebetween, and the insertion being conducted until the forwardly facing endwall abuts the shoulder of the insert.

11. The method as recited in claim 10 wherein the removing step provides an annular groove in said shell sized to receive the columns which wedgingly collapse in the passageway.

12. An apparatus for retaining an insert within a connector shell, a cross-section of said insert being smaller than a cross-section of said shell whereby to define an annular passageway therebetween for receiving said apparatus with one said shell, said insert having an axial face at the end of said passageway and the insert defining a shoulder leading to the annular passageway, the apparatus characterized by an elongated strip of deformable plastic including a scalloped front face, a rear face, and a pair of lateral end faces, said scalloped front face comprising a plurality of slots which extend generally perpendicularly from the front face rearwardly towards the rear face whereby to define a plurality of axially weak laterally separated columns which are adapted to foldingly collapse in accordion-like fashion in the annular passageway upon engagement of the scalloped front face with the axial end face, and the strip having the forward portion substantially thinner than the rearward portion, the rearward portion defining a forwardly facing endwall for abutment against the insert shoulder upon insertion in the annular passageway.

13. The apparatus as recited in claim 12 wherein said slots terminate in generally U-shaped ends.

14. The apparatus as recited in claim 12 wherein said strip has a forward portion including the slotted front face, and a rearward portion including said rear face, each said portion being generally flat with said forward portion being thinner than said rearward portion and sized to be received within said passageway.

* * * * *